US010636556B2

(12) United States Patent
Ishihara et al.

(10) Patent No.: US 10,636,556 B2
(45) Date of Patent: Apr. 28, 2020

(54) BUS BAR UNIT AND MANUFACTURING METHOD THEREOF

(71) Applicant: Honda Motor Co., Ltd., Tokyo (JP)

(72) Inventors: Yuya Ishihara, Saitama (JP); Tomohiro Fukazu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 39 days.

(21) Appl. No.: 15/712,144

(22) Filed: Sep. 22, 2017

(65) Prior Publication Data

US 2018/0090257 A1 Mar. 29, 2018

(30) Foreign Application Priority Data

Sep. 23, 2016 (JP) ..... 2016-185268

(51) Int. Cl.
*H01F 17/06* (2006.01)
*H01F 27/30* (2006.01)
(Continued)

(52) U.S. Cl.
CPC ..... *H01F 17/06* (2013.01); *H01F 27/2847* (2013.01); *H01F 27/306* (2013.01);
(Continued)

(58) Field of Classification Search
CPC ..... H01F 17/06; H01F 2007/0093
(Continued)

(56) References Cited

U.S. PATENT DOCUMENTS 8,063,728 B2 * 11/2011 Brunel ..... H01F 37/00 29/602.1
2010/0026434 A1 * 2/2010 Okamoto ..... H01F 27/266 336/65
(Continued)

FOREIGN PATENT DOCUMENTS

CN 106797707 5/2017
JP 2011254606 12/2011
(Continued)

OTHER PUBLICATIONS

"Office Action of Japan Counterpart Application," with partial English translation thereof, dated Feb. 6, 2018, p. 1-p. 6, in which the listed references were cited.
(Continued)

*Primary Examiner* — Tszfung J Chan
(74) *Attorney, Agent, or Firm* — JCIPRNET

(57) ABSTRACT

Disclosed are a bus bar unit capable of being easily manufactured while preventing a bus bar from being separated from a magnetic core and also capable of being reduced in size, and a manufacturing method thereof. The bus bar unit includes a magnetic core having a through-hole and covered with an insulating material, U-phase, V-phase and W-phase bus bars of which main body portions are arranged in parallel with each other in a predetermined direction within the through-hole and one side connecting portions provided on one side in an axial direction of the through-hole from the main body portions are bent in a direction crossing the axial direction, and a base member formed of an insulating material and to which the magnetic core is fixed, wherein the one side connecting portions of the bus bars are held while being disposed between the base member and the magnetic core.

16 Claims, 9 Drawing Sheets

(51) Int. Cl.
*H01F 27/28* (2006.01)
*H01F 37/00* (2006.01)
*H01F 17/00* (2006.01)

(52) U.S. Cl.
CPC ..... *H01F 37/00* (2013.01); *H01F 2017/0093* (2013.01); *H01F 2017/065* (2013.01)

(58) Field of Classification Search
USPC ..... 336/192
See application file for complete search history.

(56) References Cited

U.S. PATENT DOCUMENTS

| | | | | |
|---|---|---|---|---|
| 2010/0273362 | A1 | 10/2010 | Matsuoka | |
| 2012/0194311 | A1* | 8/2012 | Suzuki | H01F 27/266 336/92 |
| 2013/0039815 | A1* | 2/2013 | Murata | H01F 27/02 422/129 |
| 2017/0170610 | A1* | 6/2017 | Gunther | H01R 13/665 |
| 2017/0174152 | A1* | 6/2017 | Yamaguchi | H01F 17/062 |

FOREIGN PATENT DOCUMENTS

| | | | |
|---|---|---|---|
| JP | 2011254606 | A * | 12/2011 |
| JP | 2015230947 | | 12/2015 |
| JP | 2015230947 | A * | 12/2015 |
| JP | 2016024939 | | 2/2016 |
| JP | 2016024939 | A * | 2/2016 |

OTHER PUBLICATIONS

"Office Action of China Counterpart Application", dated Jan. 22, 2019, with English translation thereof, p. 1-p. 10.

* cited by examiner

BUS BAR UNIT AND MANUFACTURING METHOD THEREOF

CROSS-REFERENCE TO RELATED APPLICATION

This application claims the priority benefit of Japan application serial no. 2016-185268, filed on Sep. 23, 2016. The entirety of the above-mentioned patent application is hereby incorporated by reference herein and made a part of this specification.

BACKGROUND OF THE INVENTION

Field of the Invention

The invention relates to a bus bar unit and a manufacturing method thereof.

Description of Related Art

A rotary electric machine and an external power source are electrically connected to each other. A bus bar is used as an electrical connection device between the rotary electric machine and the external power source.

A current flowing through the bus bar is a relatively large current. Since a magnetic field generated when a current flows through the bus bar is a noise (electromagnetic noise) generation source, it is necessary to prevent a bad influence on peripheral electronic devices. Therefore, for example, a bus bar unit (a terminal block with a filter) as disclosed in Patent Document 1 has been proposed.

The bus bar unit of Patent Document 1 includes a magnetic core, a plurality of bus bars which pass through a hollow portion of the magnetic core, and a mold member which integrally molds the magnetic core and the plurality of bus bars. In the bus bar unit of Patent Document 1, the magnetic core removes electromagnetic noise generated from the bus bars, and thus the bad influence on the peripheral electronic devices is suppressed.

PRIOR ART DOCUMENT

Patent Documents

[Patent Document 1] Japanese Unexamined Patent Application Publication No. 2016-24939

In a conventional bus bar unit, a magnetic core and a plurality of bus bars are integrally molded with a resin material to prevent the bus bars from being separated from the magnetic core. However, generally, a complicated mold is required in a molding process. Therefore, the bus bar unit as in the related art cannot be easily manufactured. Also, a thickness or the like of the resin material used in the molding may lead to an increase in a size of the bus bar unit.

SUMMARY OF THE INVENTION

Therefore, the present invention is made in view of such problems, and an object of the present invention is to provide a bus bar unit which is capable of being easily manufactured while preventing a bus bar from being separated from a magnetic core and which is also reduced in size, and a manufacturing method thereof.

In order to achieve the aforementioned object, there is provided a bus bar unit (e.g., a bus bar unit 10 of an embodiment to be described later) according to a first aspect of the invention including a magnetic core (e.g., a magnetic core 50 of the embodiment to be described later) having a through-hole (e.g., a through-hole 50*a* of the embodiment to be described later) and covered with an insulating material, a plurality of bus bars (e.g., a U-phase bus bar 20, a V-phase bus bar 30 and a W-phase bus bar 40 of the embodiment to be described later) of which main body portions (e.g., main body portions 21, 31 and 41 of the embodiment to be described later) are arranged in parallel with each other in a predetermined direction within the through-hole and portions (e.g., one side connecting portions 22, 32 and 42 of the embodiment to be described later) thereof located on one side in an axial direction of the through-hole from the main body portions are bent in a direction crossing the axial direction, and a base member (e.g., a base member 60 of the embodiment to be described later) formed of an insulating material and to which the magnetic core is fixed, wherein the portions of the plurality of bus bars located on the one side are held in a state in which it is disposed between the base member and the magnetic core.

Further, in the bus bar unit according to a second aspect of the invention, the base member may have a partition portion (e.g., a first partition portion 62 and a second partition portion 63 of the embodiment to be described later) which partitions the plurality of bus bars within the through-hole of the magnetic core.

Further, in the bus bar unit according to a third aspect of the invention, the plurality of bus bars may be three bus bars (e.g., the U-phase bus bar 20, V-phase bus bar 30 and the W-phase bus bar 40 of the embodiment to be described later) arranged in an order of a first bus bar (e.g., the U-phase bus bar 20 of the embodiment to be described later), a second bus bar (e.g., the V-phase bus bar 30 of the embodiment to be described later) and a third bus bar (e.g., the W-phase bus bar 40 of the embodiment to be described later) in a predetermined direction and formed in elongated plate shapes, and the three bus bars may be arranged so that a surface direction of the main body portion of the first bus bar and a surface direction of the main body portion of the third bus bar are orthogonal to a surface direction of the main body portion of the second bus bar as seen in the axial direction.

Further, in the bus bar unit according to a fourth aspect of the invention, an engaging portion (e.g., engaging portions 52 and 52 of the embodiment to be described later) may protrude on an outer circumferential surface (e.g., an outer circumferential surface 51*a* of the embodiment to be described later) of the magnetic core, and an engaged portion (e.g., engaged portions 64 and 64 of the embodiment to be described later) with which the engaging portion is engaged may be provided on the base member.

Further, in the bus bar unit according to a fifth aspect of the invention, a rib (e.g., a rib 54 of the embodiment to be described later) may be provided at a connecting portion (e.g., a connecting portion 53 of the embodiment to be described later) between the outer circumferential surface of the magnetic core and the engaging portion.

Further, in the bus bar unit according to a sixth aspect of the invention, each of the portions of the plurality of bus bars located on the one side may have a holding portion (e.g., holding portions 221, 321 and 421 of the embodiment to be described later) held by the magnetic core and the base member, and a folded-back portion (e.g., folded-back portions 222, 322 and 422 of the embodiment to be described later) formed by bending the magnetic core from an outside of the magnetic core toward the magnetic core.

Further, in the bus bar unit according to a seventh aspect of the invention, a fixing portion (e.g., fixing portions 65 and 65 of the embodiment to be described later) fixed to the housing (e.g., a housing 6 of the embodiment to be described later) may be provided on the base member.

Further, a method of manufacturing the bus bar unit according to an eighth aspect of the invention includes a first assembling process in which the plurality of bus bars are inserted through the through-hole of the magnetic core, and a second assembling process in which, while the portions of the plurality of bus bars located on the one side are disposed on the base member and held between the base member and the magnetic core, the magnetic core is fixed to the base member so that the magnetic core and the plurality of bus bars are assembled with the base member.

In the bus bar unit according to the first aspect of the present invention, the bent one side portions in the plurality of bus bars are held in a state in which it is disposed between the magnetic core and the base member. Therefore, even though the magnetic core and the plurality of bus bars are not integrally molded, the bus bars can be prevented from being separated from the magnetic core. Accordingly, in the bus bar unit of the present invention, it is possible to easily manufacture the bus bars while preventing the bus bars from being separated from the magnetic core and also to reduce the size thereof.

In the bus bar unit according to the second aspect of the present invention, the base member has the partition portions which partition the plurality of bus bars within the through-hole. Therefore, it is possible to easily ensure the electrical insulation among the plurality of bus bars. Accordingly, the bus bar unit according to the present invention can suppress the cost of the insulation treatment, for example, the molding of the bus bar or the like. Furthermore, in the bus bar unit of the present invention, since the plurality of bus bars are positioned by the partition portions, it is possible to easily position and arrange the plurality of bus bars on the base member.

In the bus bar unit according to the third aspect of the present invention, since the plurality of bus bars are three bus bars and are arranged so that the surface direction of the main body portion of the first bus bar and the surface direction of the main body portion of the third bus bar are disposed to be orthogonal to the surface direction of the main body portion of the second bus bar as seen in the axial direction, the space in the predetermined direction in which the three bus bars are arranged can be saved as compared with the case in which the three bus bars are arranged in parallel with each other in the predetermined direction with the same surface direction. Accordingly, since it is possible to suppress the enlargement of the magnetic core and the through-hole in the predetermined direction, the size of the magnetic core can be reduced.

In the bus bar unit according to the fourth aspect of the present invention, the engaging portion protrudes from the outer circumferential surface of the magnetic core, and the engaged portion is provided on the base member. Therefore, when the engaging portion is engaged with the engaged portion, the magnetic core is positioned and fixed to the base member. Accordingly, in the bus bar unit of the present invention, the magnetic core can be easily positioned and fixed to the base member.

In the bus bar unit according to the fifth aspect of the present invention, the rib is provided at the connecting portion between the outer circumferential surface of the magnetic core and the engaging portion. Therefore, since the strength of the engaging portion is increased, the magnetic core can be more stably fixed to the base member.

In the bus bar unit according to the sixth aspect of the present invention, the one side connecting portions of the plurality of bus bars have the holding portions which are held by the magnetic core and the base member, and the folded-back portions which are formed by bending the one side connecting portions from the outside of the magnetic core toward the magnetic core. Therefore, since the bus bars are formed in the U shape by the main body portions, the holding portions and the folded-back portions, it is possible to reduce the size of the bus bar unit as compared with the case in which the bus bars are forming in the L shapes. Further, both ends of each of the plurality of bus bars are fixed to attachment target, and thus even when the bus bar unit oscillates due to the input of the vibration or the like from the outside, the main body portions and the folded-back portions can be easily bent to disperse the stress concentration, thereby absorbing the oscillation. Accordingly, the bus bar unit can have high reliability.

In the bus bar unit according to the seventh aspect of the present invention, the fixing portion is provided on the base member. Therefore, by fixing the base member to the housing using the fixing portion, it is possible to fix the bus bar unit to the housing. Accordingly, in the bus bar unit of the present invention, the positioning operation and the fixing operation to the housing can be easily performed.

The method of manufacturing the bus bar unit according to the eighth aspect of the present invention includes the first assembling process in which the plurality of bus bars are inserted through the through-hole of the magnetic core, and the second assembling process in which, while the one side portions of the plurality of bus bars are disposed on the base member and held between the base member and the magnetic core, the magnetic core is fixed to the base member so that the magnetic core and the plurality of bus bars are assembled with the base member. Therefore, even though the magnetic core and the plurality of bus bars are not integrally molded, the bus bars can be prevented from being separated from the magnetic core. Accordingly, in the method of manufacturing the bus bar unit according to the present invention, it is possible to easily manufacture the bus bar unit while preventing the bus bars from being separated from the magnetic core, and it is also possible to reduce the size of the bus bar unit.

DESCRIPTION OF THE EMBODIMENTS

Hereinafter, an embodiment of the present invention will be described with reference to the drawings.

Figure 1:
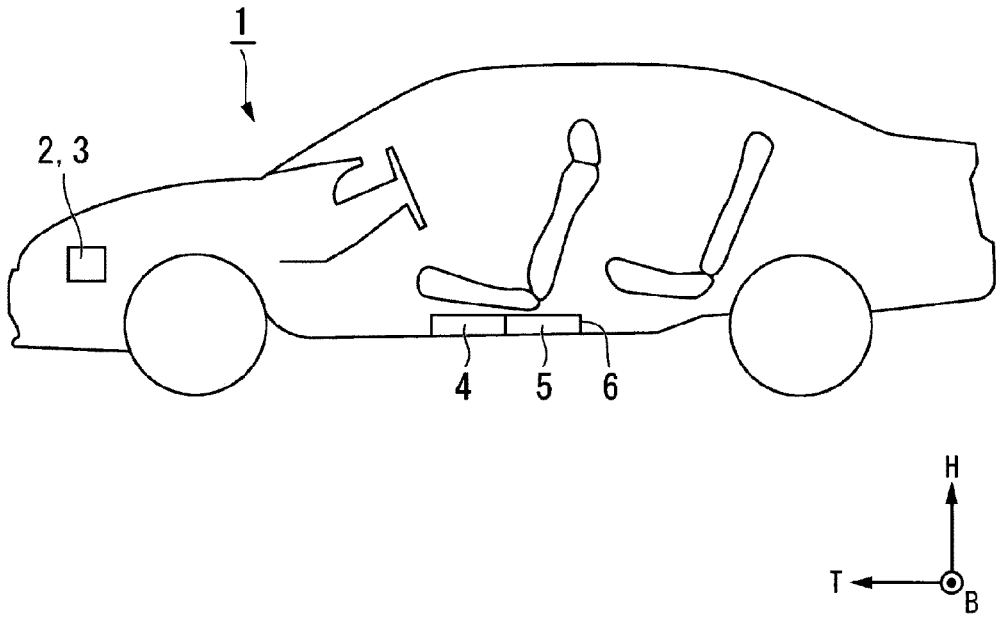
FIG. 1 is a schematic view of a vehicle with a bus bar unit according to one embodiment of the present invention.

FIG. 1 is a schematic view of a vehicle 1 with a bus bar unit 10 according to one embodiment of the present invention. In the following description, directions such as front, rear, left and right are the same as those of the vehicle 1 unless otherwise specified. Further, an arrow T in each of the drawings indicates a front of the vehicle, an arrow B indicates a left side of the vehicle, and an arrow H indicates an upper side of the vehicle.

As illustrated in FIG. 1, the vehicle 1 is a so-called hybrid vehicle which travels, for example, by an engine 2 and a rotary electric machine 3. A high-voltage battery 4 and an inverter unit 5 are mounted to be accommodated in a housing 6 at a bottom portion of the vehicle 1.

Figure 2:
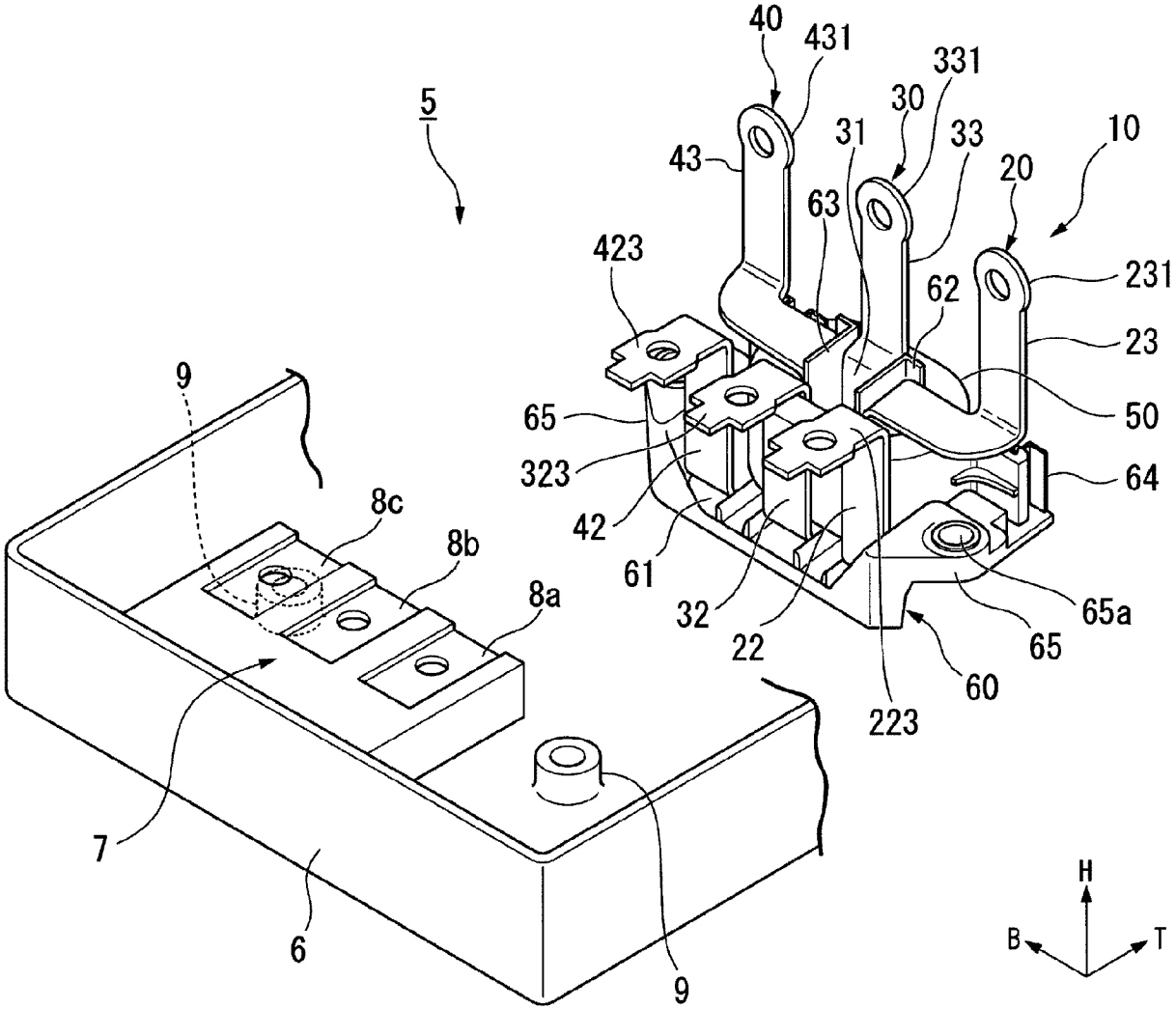
FIG. 2 is an exploded perspective view of an inverter unit with the bus bar unit.

FIG. 2 is an exploded perspective view of the inverter unit 5. As illustrated in FIG. 2, the inverter unit 5 mainly includes a power control unit (not illustrated), a terminal block 7 and a bus bar unit 10.

When electric power is supplied from the high-voltage battery 4 of a DC power supply to the rotary electric machine 3, the power control unit converts the electric power from a direct current to a three-phase alternating current. Further, when a part (regenerative energy) of an output of the engine 2 or kinetic energy of the vehicle 1 is stored in the high-voltage battery 4, the power control unit converts electric power from the rotary electric machine 3 from the three-phase alternating current to the direct current.

The terminal block 7 is integrally molded with a three-phase connector to which three-phase wires (none of which is illustrated) are connected outside the housing 6. The terminal block 7 has phase terminals 8*a* to 8*c* which input and output three-phase AC. The phase terminals 8*a* to 8*c* are electrically and mechanically connected to bus bars including a U-phase bus bar 20, a V-phase bus bar 30 and a W-phase bus bar 40, which will be described later, constituting the bus bar unit 10. Each of the phase terminals 8*a* to 8*c* is arranged, for example, in a left and right direction.

In the housing 6, attachment seat portions 9 and 9 for fixing the bus bar unit 10 are provided outside the phase terminals 8*a* to 8*c*. The attachment seat portions 9 and 9 are formed to protrude upward from an inner bottom surface of the housing 6.

Figure 3:
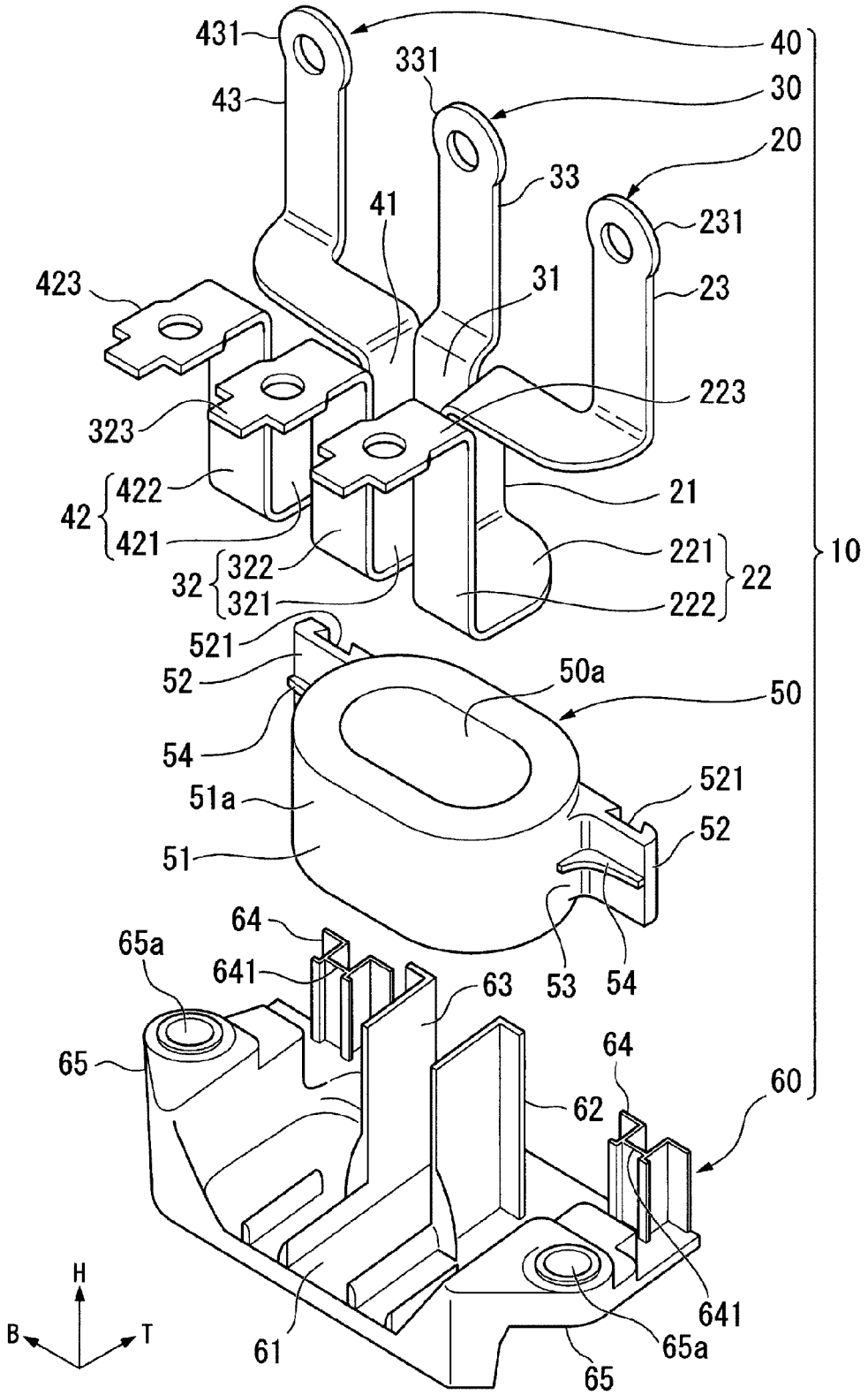
FIG. 3 is an exploded perspective view of the bus bar unit of FIG. 2.

FIG. 3 is an exploded perspective view of the bus bar unit 10. The bus bar unit 10 includes a magnetic core 50, a plurality (three) of bus bars 20, 30 and 40 and a base member 60.

The magnetic core 50 includes a magnetic core body 51 and a pair of engaging portions 52 and 52 which protrude from an outer circumferential surface 51*a* of the magnetic core body 51.

The magnetic core body 51 is formed in an annular shape and also has an oval shape as seen in an axial direction thereof. The magnetic core body 51 has a through-hole 50*a* at a center thereof. The magnetic core body 51 has a magnetic material therein which is capable of shielding electromagnetic noise generated due to a current flowing through each of the bus bars. The magnetic material may be ferrite, an electromagnetic steel plate, an amorphous alloy or the like. The magnetic material is buried in an insulating material such as a resin material. Accordingly, a surface of the magnetic core 50 is covered with the insulating material.

Each of the pair of engaging portions 52 and 52 is formed to extend from the outer circumferential surface 51*a* of the magnetic core body 51 in a radial direction of the magnetic core main body 51. The pair of engaging portions 52 and 52 are formed of an insulating material such as a resin material. An engaging groove 521 is formed on one main surface of each engaging portion 52. The engaging groove 521 extends in the axial direction of the magnetic core body 51.

A rib 54 having a predetermined thickness is provided at a connecting portion 53 between the other main surface of each engaging portion 52 and the outer circumferential surface 51*a* of the magnetic core body 51. The rib 54 is formed of an insulating material such as a resin material. The rib 54 is formed to extend from the outer circumferential surface 51*a* of the magnetic core body 51 to the engaging portion 52 via the connecting portion 53.

The three bus bars 20, 30 and 40 are the U-phase bus bar 20, the V-phase bus bar 30 and the W-phase bus bar 40. Each of the three bus bars 20, 30 and 40 is an elongated plate-shaped member formed of a metal material such as copper or aluminum and is forming to have a desired shape, for example, by press-molding. The three bus bars 20, 30 and 40 are inserted through the through-hole 50*a* of the magnetic core 50 in a state in which main body portions 21, 31 and 41 are arranged in a predetermined direction (lengthwise direction of the through-hole 50*a* in the embodiment). Portions of the three bus bars 20, 30 and 40 which are located on one side in an axial direction of the through-hole 50*a* from the main body portions 21, 31 and 41 are bent in a direction orthogonal to the axial direction of the through-hole 50*a*.

The U-phase bus bar 20 has one side connecting portion 22 which is provided on one side in the axial direction of the through-hole 50*a* from the main body portion 21 and an other side connecting portion 23 which is provided on the other side in the axial direction of the through-hole 50*a* from the main body portion 21.

The main body portion 21 extends in the axial direction of the through-hole 50*a*. The main body portion 21 is a portion which is disposed in the through-hole 50*a* of the magnetic core 50.

The one side connecting portion 22 has a holding portion 221 and a folded-back portion 222.

The holding portion 221 is bent in a direction orthogonal to the axial direction of the through-hole 50*a*. The holding portion 221 is held in a state in which it is disposed between the magnetic core 50 and the base member 60. In the embodiment, the holding portion 221 is interposed between the magnetic core 50 and the base member 60.

The folded-back portion 222 is formed by bending the one side connecting portion 22 from an outside of the magnetic core 50 toward the magnetic core 50.

A tip end 223 of the one side connecting portion 22 is formed in an annular shape. The tip end 223 is fastened and fixed to a U-phase terminal 8*a* (refer to FIG. 2) by, for example, a bolt or the like.

The other side connecting portion 23 is bent from an end of the main body portion 21 in a direction orthogonal to the axial direction of the through-hole 50*a*. The other side connecting portion 23 is further bent at an intermediate portion thereof and extends in the axial direction of the through-hole 50*a*. A tip end 231 of the other side connecting portion 23 is formed in an annular shape. The tip end 231 is fastened and fixed to a terminal block (not illustrated) on the power control unit side by a bolt or the like.

The V-phase bus bar 30 has the main body portion 31, one side connecting portion 32 and the other side connecting portion 33.

The main body portion 31 extends in the axial direction of the through-hole 50*a*. The main body portion 31 is a portion which is disposed in the through-hole 50*a* of the magnetic core 50.

The one side connecting portion 32 has a holding portion 321 and a folded-back portion 322.

The holding portion 321 is bent in a direction orthogonal to the axial direction of the through-hole 50*a*. The holding portion 321 is held in a state in which it is disposed between the magnetic core 50 and the base member 60 (refer to FIG. 4).

The folded-back portion 322 is formed by bending the one side connecting portion 32 from an outside of the magnetic core 50 toward the magnetic core 50. A tip end 323 of the folded-back portion 322 is formed in an annular shape. The tip end 323 is fastened and fixed to a V-phase terminal 8*b* (refer to FIG. 2) by, for example, a bolt or the like.

The other side connecting portion 33 is bent in a crank shape and then extends in the axial direction of the through-hole 50*a*. A tip end of 331 of the other side connecting portion 33 is formed in an annular shape. The tip end 331 is fastened and fixed to the terminal block (not illustrated) on the power control unit side by a bolt or the like.

The W-phase bus bar 40 has one side connecting portion 42 which is provided on one side in the axial direction of the through-hole 50*a* from the main body portion 41 and an other side connecting portion 43 which is provided on the other side in the axial direction of the through-hole 50*a* from the main body portion 41. The one side connecting portion 42 has a holding portion 421 and a folded-back portion 422. The holding portion 421 is interposed in a state in which it is disposed between the magnetic core 50 and the base member 60. A tip end 423 of the one side connecting portion 42 is fastened and fixed to a W-phase terminal 8*c* (refer to FIG. 2) by, for example, a bolt or the like. A tip end 431 of the other side connecting portion 43 is fastened and fixed to the terminal block (not illustrated) on the power control unit side by a bolt or the like.

Since the W-phase bus bar 40 is formed symmetrically with the U-phase bus bar 20, a detailed description thereof will be omitted.

The holding portions 221, 321 and 421 of the one side connecting portions 22, 32 and 42 of the three bus bars 20, 30 and 40 are disposed on the base member 60. The base member 60 holds the holding portions 221, 321 and 421 of the three bus bars 20, 30 and 40 with the magnetic core 50, and the magnetic core 50 is also fixed thereto.

The base member 60 is formed of an insulating material such as a resin material. The base member 60 is formed with an arrangement portion 61 in which the holding portions 221, 321 and 421 are arranged. A first partition portion 62 and a second partition portion 63 are erected from the arrangement portion 61.

The first partition portion 62 is disposed between the main body portion 21 of the U-phase bus bar 20 and the main body portion 31 of the V-phase bus bar 30 in the through-hole 50*a* of the magnetic core 50 and partitions the U-phase bus bar 20 and the V-phase bus bar 30. The first partition portion 62 is formed of an insulating material such as a resin material. The first partition portion 62 is formed in an approximate L-shaped plate shape which is bent to cover the main body portion 21 of the U-phase bus bar 20 as seen in the axial direction of the through-hole 50*a*.

The second partition portion 63 is disposed between the main body portion 31 of the V-phase bus bar 30 and the main body portion 41 of the W-phase bus bar 40 in the through-hole 50*a* of the magnetic core 50 and partitions the V-phase bus bar 30 and the W-phase bus bar 40. The second partition portion 63 is formed of an insulating material such as a resin material. The second partition portion 63 is formed symmetrically with the first partition portion 62. The second partition portion 63 is formed in an approximate L-shaped plate shape which is bent to cover the main body portion 41 of the W-phase bus bar 40 as seen in the axial direction of the through-hole 50*a*.

In the arrangement portion 61, a pair of engaged portions 64 and 64 are provided at positions corresponding to the pair of engaging portions 52 and 52 of the magnetic core 50. Each engaged portion 64 is erected from the base member 60. In each engaged portion 64, a protrusion 641 extends in the axial direction of the through-hole 50*a*. The protrusion 641 is engaged with the engaging groove 521 provided in the engaging portion 52 of the magnetic core 50. Accordingly, the magnetic core 50 is fixed to the base member 60.

A pair of fixing portions 65 and 65 are provided on the arrangement portion 61. A fixing hole 65*a* is provided in each of the fixing portions 65 and 65 using a cylindrical collar or the like which is formed of, for example, a metal material. The fixing portions 65 and 65 are fixed by bolts or the like inserted into the fixing holes 65*a* being fastened to the attachment seat portions 9 and 9 of the housing 6. The bus bar unit 10 is accommodated and fixed in the housing 6 by fixing the fixing portions 65 and 65 to the attachment seat portions 9 and 9.

Figure 4:
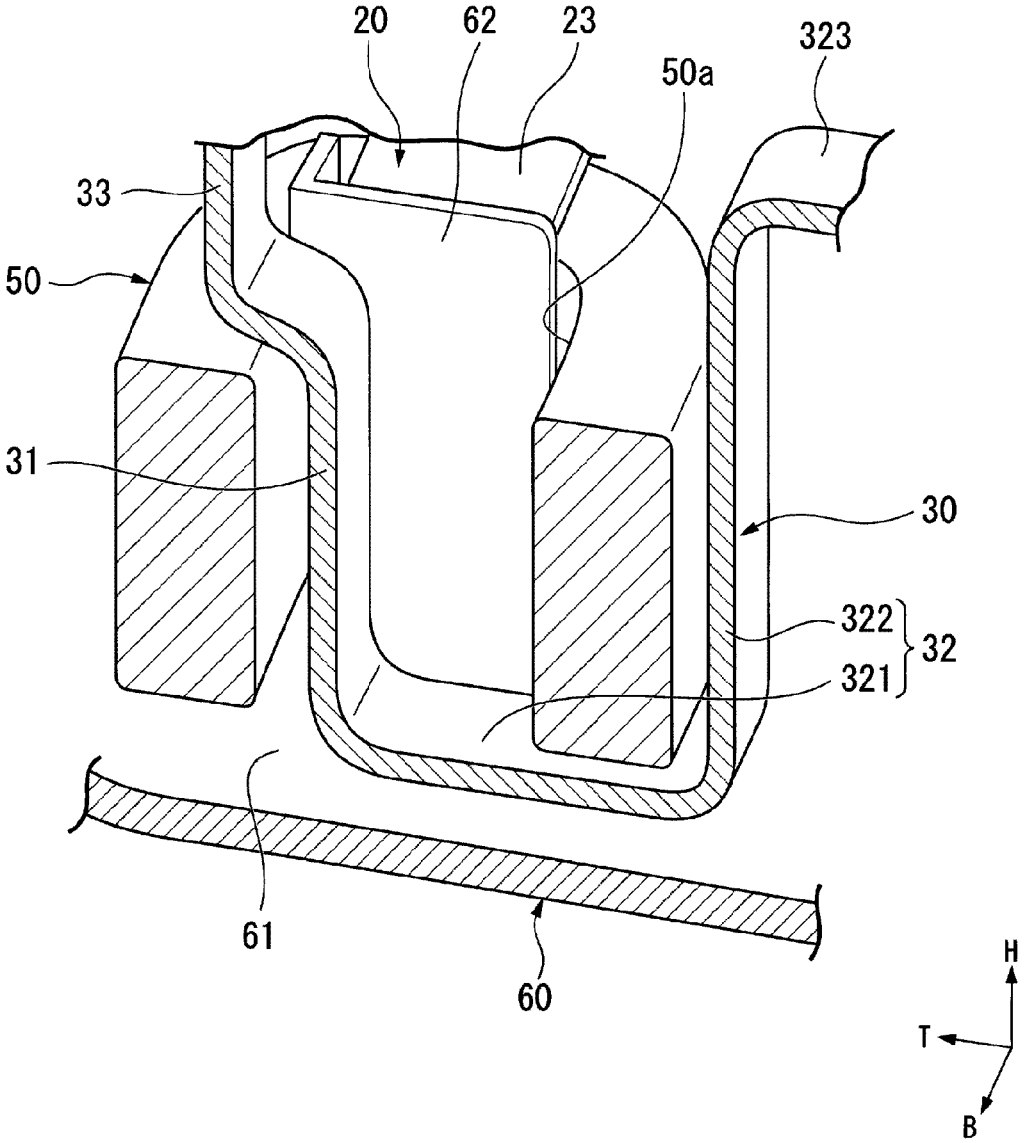
FIG. 4 is a perspective view illustrating a state in which a V-phase bus bar is interposed between a magnetic core and a base member.

FIG. 4 is a perspective view illustrating a state in which the V-phase bus bar 30 is interposed and held between the magnetic core 50 and the base member 60.

Figure 5:
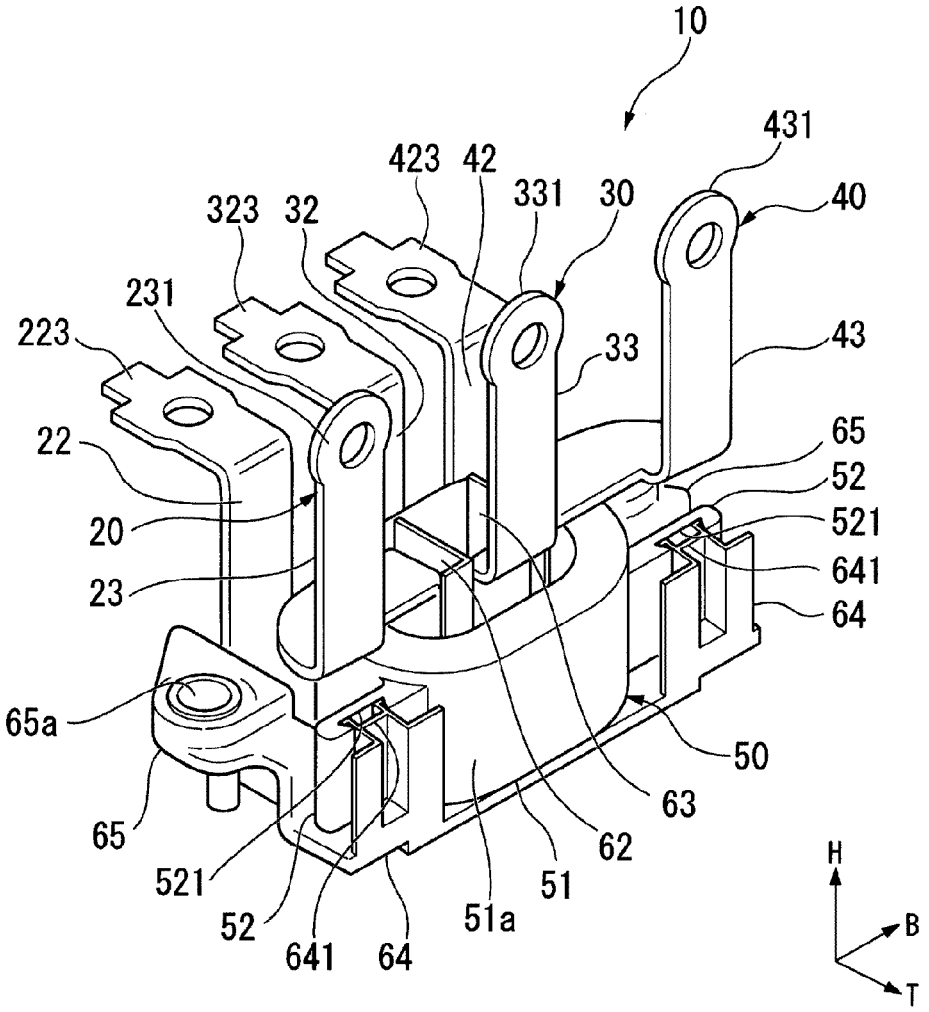
FIG. 5 is a perspective view of the bus bar unit of FIG. 2 as seen from an arrow T side.

FIG. 5 is a perspective view of the bus bar unit of FIG. 2 as seen from an arrow T side.

Here, the three bus bars 20, 30 and 40 are formed in a U shape as a whole by the main body portions 21, 31 and 41, the holding portions 221, 321 and 421 and the folded-back portions 222, 322 and 422, respectively. For example, as illustrated in FIG. 4, the V-phase bus bar 30 is formed in a U shape as a whole by the main body portion 31, the holding portion 321, and the folded-back portion 322.

Therefore, as illustrated in FIG. 5, by forming the three bus bars 20, 30 and 40 in the U shape as a whole, it is possible to reduce a size of the bus bar unit 10 as compared with the case in which the three bus bars 20, 30 and 40 are formed in L shapes. Also, both ends of each of the three bus bars 20, 30 and 40 are fixed to the terminal block of the power control unit and the terminal block 7 of the three-phase connector, and thus even when the bus bar unit 10 oscillates due to an input of vibration or the like from the outside, the main body portions 21, 31 and 41 and the folded-back portions 222, 322 and 422 are easily bent.

Figure 6:
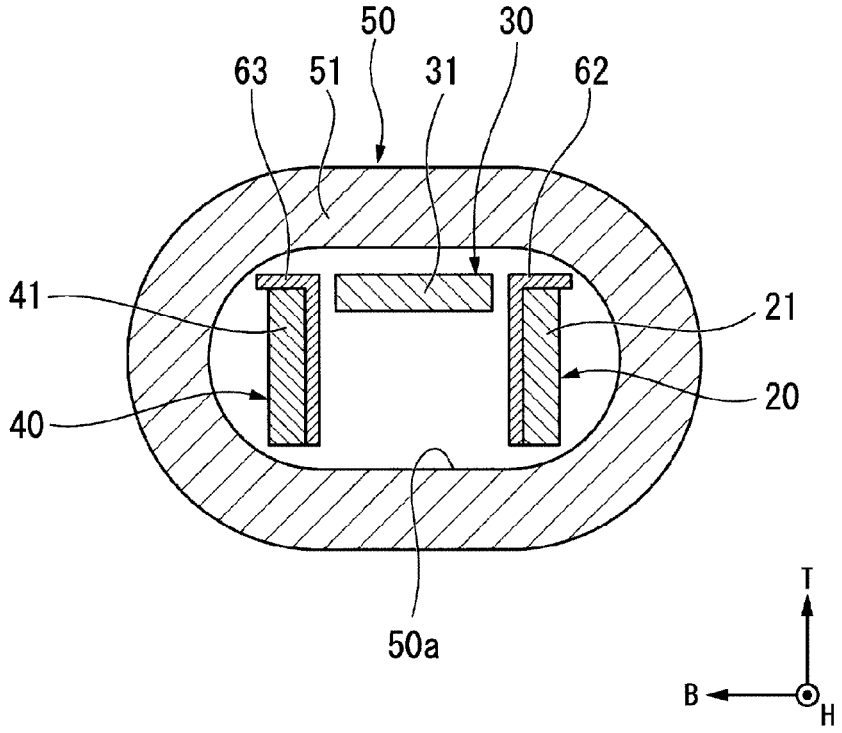
FIG. 6 is a cross-sectional view illustrating an arrangement state of three bus bars in a through-hole of the magnetic core.

FIG. 6 is a cross-sectional view illustrating an arrangement state of the three bus bars 20, 30 and 40 in the through-hole 50*a* of the magnetic core 50.

As illustrated in FIG. 6, the main body portions 21, 31 and 41 of the three bus bars 20, 30 and 40 are arranged so that a surface direction of the main body portion 21 of the U-phase bus bar 20 and a surface direction of the main body portion 41 of the W-phase bus bar 40 are disposed to be orthogonal to a surface direction of the main body portion 31 of the V-shape bus bar 30 as seen in the axial direction of the through-hole 50*a*.

Next, a method for manufacturing the above-described bus bar unit 10 will be described.

Figure 7:
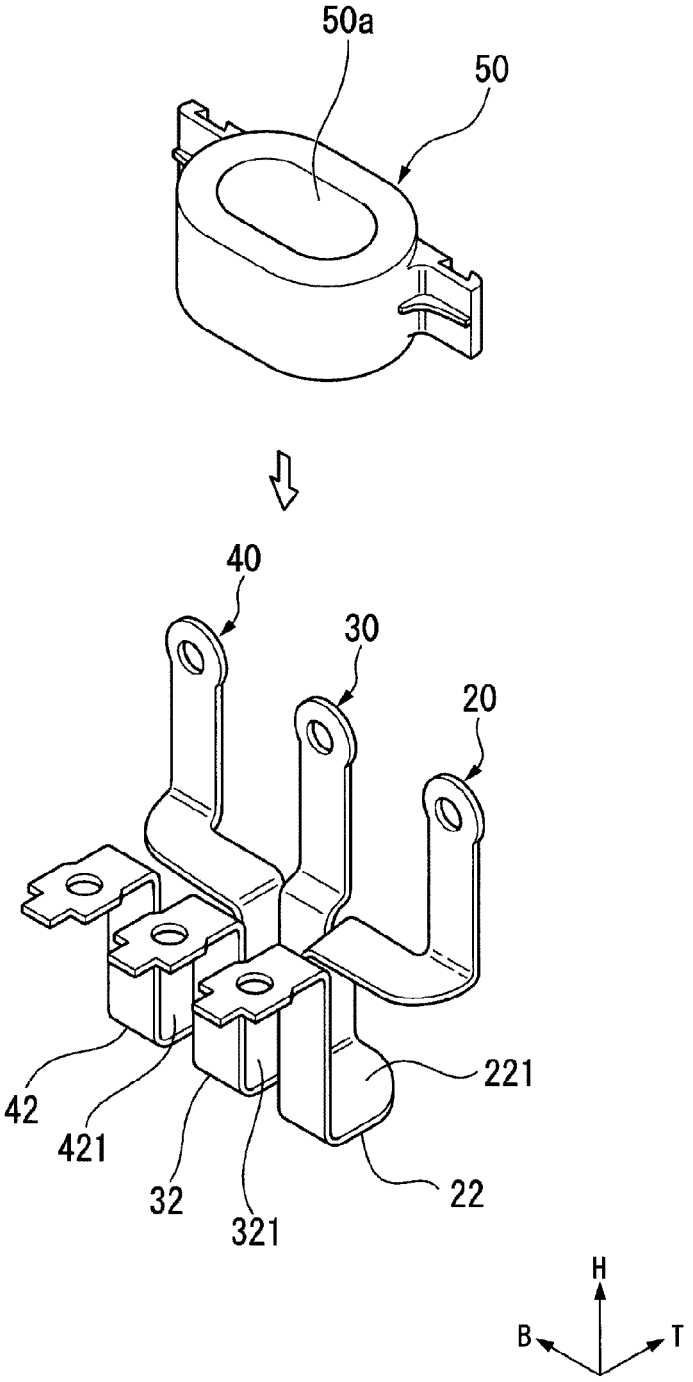
FIG. 7 is a view illustrating a first assembling process in a manufacturing method of the bus bar unit.
Figure 8:
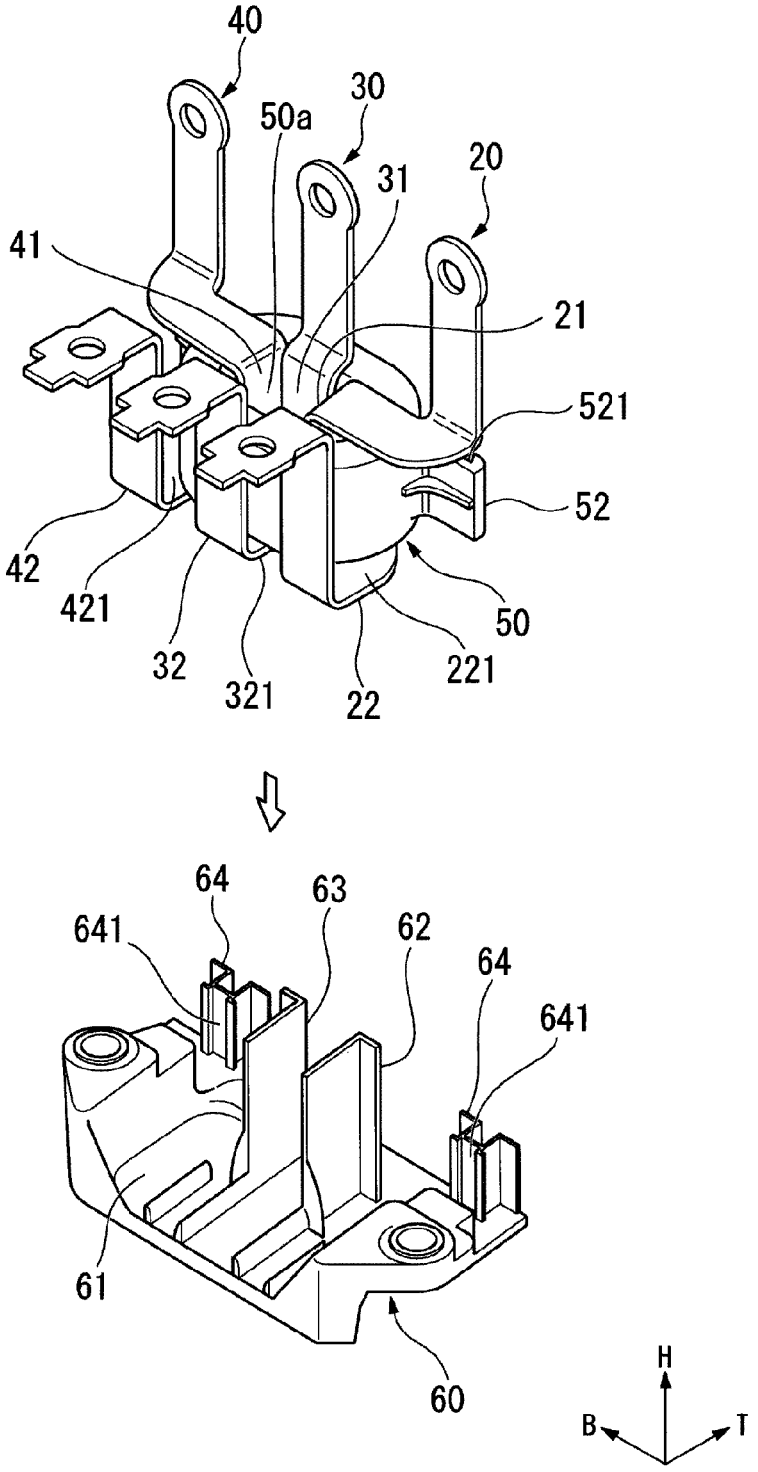
FIG. 8 is a view illustrating a second assembling process in a manufacturing method of the bus bar unit.
Figure 9:
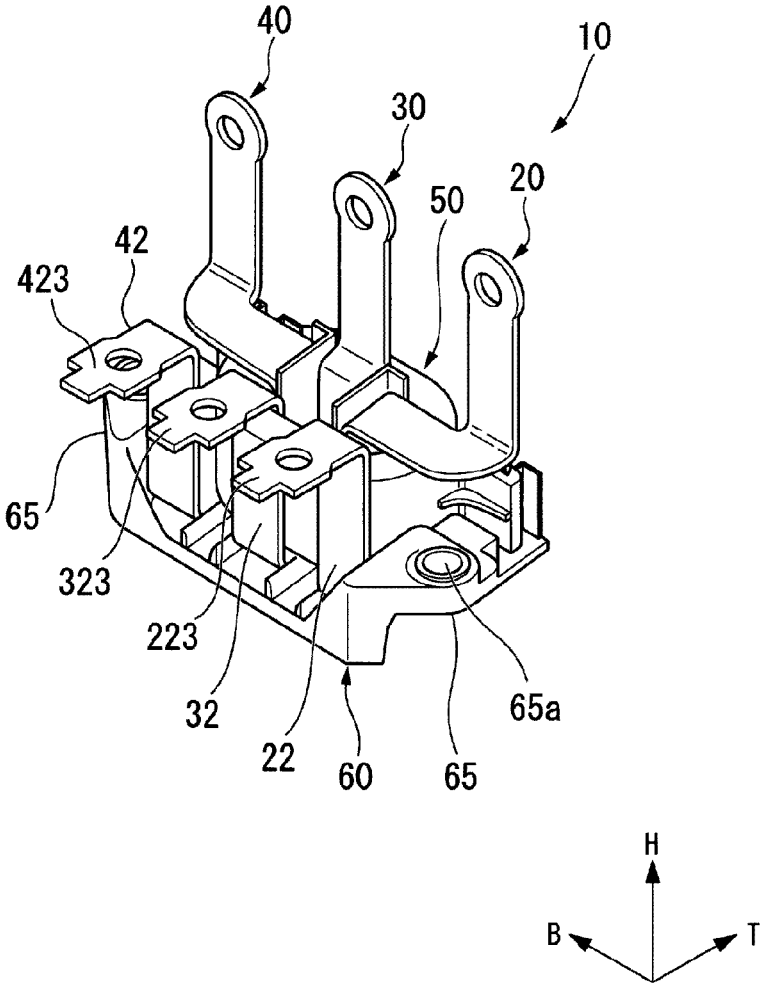
FIG. 9 is a view illustrating a completed bus bar unit.

FIG. 7 is a view illustrating a first assembling process in a manufacturing method of the bus bar unit, FIG. 8 is a view illustrating a second assembling process in a manufacturing method of the bus bar unit, and FIG. 9 is a view illustrating the completed bus bar unit 10.

A method for manufacturing the bus bar unit includes a first assembling process and a second assembling process.

As illustrated in FIG. 7, in the first assembling process, the three bus bars 20, 30 and 40 are inserted through the through-hole 50*a* of the magnetic core 50. Therefore, the main body portions 21, 31 and 41 of the three bus bars 20, 30 and 40 are disposed in the through-hole 50*a* of the magnetic core 50.

As illustrated in FIG. 8, in the second assembling process, the first partition portion 62 is disposed between the main body portion 21 of the U-phase bus bar 20 and the main body portion 31 of the V-phase bus bar 30 in the through-hole 50*a* of the magnetic core 50, and the second partition portion 63 is disposed between the main body portion 31 of the V-phase bus bar 30 and the main body portion 41 of the W-phase bus bar 40. Further, the protrusions 641 and 641 of the engaged portions 64 and 64 of the base member 60 are inserted into the engaging grooves 521 and 521 of the engaging portions 52 and 52 of the magnetic core 50. Accordingly, while the holding portions 221, 321 and 421 of the three bus bars 20, 30 and 40 are disposed in the arrangement portion 61 of the base member 60 and held between the base member 60 and the magnetic core 50, the magnetic core 50 can be fixed to the base member 60, and the magnetic core 50 and the three bus bars 20, 30 and 40 can be assembled with the base member 60.

As a result, as illustrated in FIG. 9, the magnetic core 50 and the three bus bars 20, 30 and 40 are assembled with the base member 60.

In the bus bar unit 10 according to the embodiment, the bent one side connecting portions 22, 32 and 42 of the three bus bars 20, 30 and 40 are held in a state in which it is disposed between the magnetic core 50 and the base member 60. Therefore, even though the magnetic core 50 and the three bus bars 20, 30 and 40 are not integrally molded, the three bus bars 20, 30 and 40 can be prevented from being separated from the magnetic core 50. Accordingly, in the bus bar unit of the embodiment, it is possible to easily manufacture the three bus bars 20, 30 and 40 while preventing the three bus bars 20, 30 and 40 from being separated from the magnetic core 50 and also to reduce a size thereof.

Further, in the bus bar unit 10 according to the embodiment, the base member 60 has the first partition portion 62 and the second partition portion 63 which partition the three bus bars 20, 30 and 40 within the through-hole 50*a*. Therefore, it is possible to easily ensure electrical insulation among the three bus bars 20, 30 and 40. Accordingly, a cost of insulation treatment of the bus bar unit 10 according to the embodiment, for example, molding of the bus bar or the like, can be suppressed. Furthermore, in the bus bar unit 10 of the present invention, since the three bus bars 20, 30 and 40 are positioned by the first partition portion 62 and the second partition portion 63, it is possible to easily position and arrange the three bus bars 20, 30 and 40 on the base member 60.

Further, since the bus bar unit 10 according to the embodiment has the three bus bars 20, 30 and 40 and is arranged so that the surface direction of the main body portion 21 of the U-phase bus bar 20 and the surface direction of the main body portion 41 of the W-phase bus bar 40 are disposed to be orthogonal to the surface direction of the main body portion 31 of the V-shape bus bar 30 as seen in the axial direction, space in a predetermined direction in which the three bus bars 20, 30 and 40 are arranged can be saved as compared with the case in which the three bus bars 20, 30, and 40 are arranged in parallel with each other in a predetermined direction with the same surface direction. Accordingly, since it is possible to suppress enlargement of the magnetic core 50 and the through-hole 50*a* in a predetermined direction, a size of the magnetic core 50 can be reduced.

Further, in the bus bar unit 10 according to the embodiment, the engaging portion 52 protrudes from the outer circumferential surface 51*a* of the magnetic core 50, and the engaged portion 64 is provided on the base member 60. Therefore, when the engaging portion 52 is engaged with the engaged portion 64, the magnetic core 50 is positioned and fixed to the base member 60. Accordingly, in the bus bar unit 10 of the embodiment, the magnetic core 50 can be easily positioned and fixed to the base member 60.

Further, in the bus bar unit 10 according to the embodiment, the rib 54 is provided at the connecting portion 53 between the outer circumferential surface 51*a* of the magnetic core 50 and the engaging portion 52. Therefore, since strength of the engaging portion 52 is increased, the magnetic core 50 can be more stably fixed to the base member 60.

Further, in the bus bar unit 10 according to the embodiment, the one side connecting portions 22, 32 and 42 of the three bus bars 20, 30 and 40 have the holding portions 221, 321 and 421 which are held by the magnetic core 50 and the base member 60, and the folded-back portions 222, 322 and 422 which are formed by bending the one side connecting portions 22, 32 and 42 from the outside of the magnetic core 50 toward the magnetic core 50, respectively. Therefore, since the three bus bars 20, 30 and 40 are formed in the U shapes by the main body portions 21, 31 and 41, the holding portions 221, 321 and 421 and the folded-back portions 222, 322 and 422, respectively, it is possible to reduce the size of the bus bar unit 10 as compared with the case in which the three bus bars 20, 30 and 40 are formed in the L shapes. Both ends of each of the three bus bars 20, 30 and 40 are fixed to the terminal block of the power control unit and the terminal block 7 of the three-phase connector, and thus even when the bus bar unit 10 oscillates due to the input of the vibration or the like from the outside, the main body portions 21, 31 and 41 and the folded-back portions 222, 322 and 422 can be easily bent to disperse stress concentration, thereby absorbing the oscillation. Accordingly, the bus bar unit 10 can have high reliability.

Further, in the bus bar unit 10 according to the embodiment, the fixing portion 65 is provided on the base member 60. Therefore, by fixing the base member 60 to the housing 6 using the fixing portion 65, it is possible to fix the bus bar unit 10 to the housing 6. Accordingly, in the bus bar unit 10 of the embodiment, the positioning operation and the fixing operation to the housing 6 can be easily performed.

Further, the method of manufacturing the bus bar unit according to the embodiment includes the first assembling process in which the three bus bars 20, 30 and 40 are inserted through the through-hole 50*a* of the magnetic core 50, and the second assembling process in which, while the one side connecting portions 22, 32 and 42 of the three bus bars 20, 30 and 40 are disposed on the base member 60 and held between the base member 60 and the magnetic core 50, the magnetic core 50 is fixed to the base member 60 so that the magnetic core 50 and the three bus bars 20, 30 and 40 are assembled with the base member 60. Therefore, even though the magnetic core 50 and the three bus bars 20, 30 and 40 are not integrally molded, the three bus bars 20, 30 and 40 can be prevented from being separated from the magnetic core 50. Accordingly, in the method of manufacturing the bus bar unit according to the embodiment, it is possible to easily manufacture the bus bar unit 10 while preventing the three bus bars 20, 30 and 40 from being separated from the magnetic core 50, and it is also possible to reduce the size of the bus bar unit 10.

In addition, the present invention is not limited to the embodiment described with reference to the drawings, and various modifications are conceivable in the technical scope thereof.

For example, in the embodiment, the case in which the number of bus bars is three has been described. However, the number of bus bars is not limited to three and it is sufficient if they are plural. Also, in the embodiment, the magnetic core 50 is fixed to the base member 60 through engagement. However, the magnetic core 50 may be fixed to the base member 60 by other methods.

Also, in the embodiment, although the holding portions 221, 321 and 421 of the three bus bars 20, 30 and 40 are interposed and held between the base member 60 and the magnetic core 50, the present invention is not limited to the case in which they are interposed and held therebetween. As long as the holding portions 221, 321 and 421 of the three bus bars 20, 30 and 40 are disposed at least between the base member 60 and the magnetic core 50, the three bus bars 20, 30 and 40 can be prevented from being separated from the magnetic core 50.

Also, in the embodiment, a "first bus bar" in the aspects of the invention is the U-phase bus bar 20, a "second bus bar" in the aspects of the invention is the V-phase bus bar 30, and a "third bus bar" in the aspects of the invention is the W-phase bus bar 40, but the present invention is not limited thereto. Therefore, for example, the "first bus bar" in the aspects of the invention may be the V-phase bus bar 30, the "second bus bar" in the aspects of the invention may be the W-phase bus bar 40 and the "third bus bar" in the aspects of the invention may be the U-phase bus bar 20.

Further, materials, shapes or the like of the U-phase bus bar 20, the V-phase bus bar 30 and the W-phase bus bar 40 are not limited to those of the present embodiment. Further, materials, shapes or the like of the magnetic core 50 and the base member 60 are not limited to those of the present embodiment.

Also, in the embodiment, although the so-called hybrid vehicle having the engine 2, the rotary electric machine 3, the high-voltage battery 4 and the inverter unit 5 has been described as an example of the vehicle 1 with the bus bar unit 10, the vehicle 1 is not limited to the hybrid vehicle. That is, the vehicle 1 may be a vehicle in which at least the rotary electric machine for supplying a driving force and the power control unit are installed. Therefore, the vehicle 1 may be a so-called fuel cell vehicle or an electric vehicle which travels with the driving force of the rotary electrical machine. Also, in the embodiment, the case in which the bus bar unit 10 is applied to the vehicle 1 has been described, but the bus bar unit 10 may be applied to applications other than the vehicle 1, for example, installation type power distribution equipment.

In addition, it is possible to appropriately replace the elements in the embodiment with known elements within the scope not deviating from the gist of the present invention.

What is claimed is:

1. A bus bar unit comprising:

a magnetic core having a through-hole and covered with an insulating material, a plurality of bus bars of which main body portions are arranged in parallel with each other in a predetermined direction within the through-hole and portions thereof located on one side in an axial direction of the through-hole from the main body portions are bent in a direction crossing the axial direction, and a base member formed of an insulating material and to which the magnetic core is fixed, wherein the portions of the plurality of bus bars located on the one side are held in a state in which the portions of the plurality of bus bars located on the one side are disposed between the base member and the magnetic core, and wherein the plurality of bus bars comprise three bus bars arranged in an order of a first bus bar, a second bus bar and a third bus bar in a predetermined direction and formed in elongated plate shapes, and the three bus bars are arranged so that a width direction of the main body portion of the first bus bar and a width direction of the main body portion of the third bus bar are orthogonal to a width direction of the main body portion of the second bus bar as seen in the axial direction.

2. The bus bar unit according to claim 1, wherein the base member has a partition portion which partitions the plurality of bus bars within the through-hole of the magnetic core.

3. The bus bar unit according to claim 1, wherein an engaging portion protrudes from an outer circumferential surface of the insulating material covering the magnetic core, and an engaged portion with which the engaging portion is engaged is provided on the base member.

4. The bus bar unit according to claim 3, wherein a rib is provided at a connecting portion between the outer circumferential surface of the magnetic core and the engaging portion.

5. The bus bar unit according to claim 1, wherein each of the portions of the plurality of bus bars located on the one side has a holding portion held by the magnetic core and the base member, and a folded-back portion formed by bending the magnetic core from an outside of the magnetic core toward the magnetic core.

6. The bus bar unit according to claim 1, wherein a fixing portion fixed to a housing is provide on the base member.

7. A method of manufacturing the bus bar unit according to claim 1, the method comprising:

a first assembling process in which the plurality of bus bars are inserted through the through-hole of the magnetic core, and a second assembling process in which, while the portions of the plurality of bus bars located on the one side are disposed on the base member and held between the base member and the magnetic core, the magnetic core is fixed to the base member so that the magnetic core and the plurality of bus bars are assembled with the base member.

8. The bus bar unit according to claim 2, wherein an engaging portion protrudes on an outer circumferential surface of the magnetic core, and an engaged portion with which the engaging portion is engaged is provided on the base member.

9. The bus bar unit according to claim 1, wherein an engaging portion protrudes on an outer circumferential surface of the magnetic core, and an engaged portion with which the engaging portion is engaged is provided on the base member.

10. The bus bar unit according to claim 2, wherein each of the portions of the plurality of bus bars located on the one side has a holding portion held by the magnetic core and the base member, and a folded-back portion formed by bending the magnetic core from an outside of the magnetic core toward the magnetic core.

11. The bus bar unit according to claim 3, wherein each of the portions of the plurality of bus bars located on the one side has a holding portion held by the magnetic core and the base member, and a folded-back portion formed by bending the magnetic core from an outside of the magnetic core toward the magnetic core.

12. The bus bar unit according to claim 4, wherein each of the portions of the plurality of bus bars located on the one side has a holding portion held by the magnetic core and the base member, and a folded-back portion formed by bending the magnetic core from an outside of the magnetic core toward the magnetic core.

13. The bus bar unit according to claim 2, wherein a fixing portion fixed to a housing is provide on the base member.

14. The bus bar unit according to claim 3, wherein a fixing portion fixed to a housing is provide on the base member.

15. The bus bar unit according to claim 4, wherein a fixing portion fixed to a housing is provide on the base member.

16. The bus bar unit according to claim 5, wherein a fixing portion fixed to a housing is provide on the base member.

* * * * *